United States Patent [19]

Löf

[11] Patent Number: 5,040,621

[45] Date of Patent: Aug. 20, 1991

[54] FLUSHING MEANS FOR DRILLING TOOLS

[75] Inventor: Stig U. Löf, Sunne, Sweden.

[73] Assignee: Uniroc Aktiebolag, Fagersta, Sweden

[21] Appl. No.: 503,813

[22] Filed: Apr. 3, 1990

[30] Foreign Application Priority Data

Apr. 5, 1989 [SE] Sweden ..... 8901200

[51] Int. Cl.[5] ..... E21B 7/20; E21B 10/32; E21B 10/60; E21B 21/10

[52] U.S. Cl. ..... 175/258; 175/171; 175/324; 175/385; 175/393; 175/398; 175/415

[58] Field of Search ..... 175/258, 292, 398, 171, 175/257, 324, 385, 399, 415, 393

[56] References Cited

U.S. PATENT DOCUMENTS

| | | | |
|---|---|---|---|
| 1,613,863 | 1/1927 | Zublin | 175/398 |
| 2,485,826 | 10/1949 | Harinck | 175/171 X |
| 3,370,658 | 2/1968 | Jansson | 175/390 X |
| 3,848,683 | 11/1974 | Persson | 175/258 X |
| 3,870,114 | 3/1975 | Pulk | 175/258 |
| 4,196,783 | 4/1980 | Lof | 175/398 X |
| 4,408,669 | 10/1983 | Wiredal | 175/258 |
| 4,620,600 | 11/1986 | Persson | 175/398 X |
| 4,765,416 | 8/1988 | Bjerking et al. | 175/257 X |
| 4,817,741 | 4/1989 | Lof | 175/398 |

FOREIGN PATENT DOCUMENTS

| | | | |
|---|---|---|---|
| 821404 | 8/1969 | Canada . | |
| 263088 | 4/1988 | European Pat. Off. . | |
| 2031481 | 4/1980 | United Kingdom | 175/398 |

*Primary Examiner*—Hoang C. Dang

*Attorney, Agent, or Firm*—Eric Y. Munson; Mark P. Stone

[57] ABSTRACT

A flushing device for drilling tools comprises a guide member (10) carrying a drill bit (20) and being rotatably centered by the mouth of a casing tube (11) which is adapted to follow the drilling tool downhole during drilling. The drill bit (20) has a bit portion (22) that projects laterally beyond and is spaced axially in front of the casing tube (11) so as to drill a hole larger than the casing tube (11). There are external flushing grooves (70,71) on the guide member (10) adapted to lead the outflow of flushing medium and debris from the hole during drilling into the casing tube (11). At least one of these grooves (70) extends from front to rear of the guide member (10). One or more further grooves (71) are open towards said rear while ending blindly into the periphery of the guide member (10) spaced from its front. By retraction of the guide member (10) its front enters the casing tube (11). That closes the blind grooves (71) and an intensified flushing is thus possible via the remaining open grooves (70) that extends from front to rear of the guide member (10). The cutting front (40) of the bit portion (22) is flushed rotatively in counter flow to the rotational drilling direction (8) towards the full length groove (70).

14 Claims, 2 Drawing Sheets

FLUSHING MEANS FOR DRILLING TOOLS

The present invention relates to flushing means for drilling tools intended for drilling in earth and in rock covered by overburden concurrently with a casing tube (11) following the drilling tool downhole, in particular of the type incorporating passages for supplying flushing medium to the hole during drilling, a guide member rotatably centered by said casing tube and having at least one outer flushing groove thereon for the outflow of flushing medium and drilling debris from said hole into said casing tube during drilling, and a drill bit supported by said guide member and provided with a bit portion thereon spaced from and projecting laterally beyond said casing tube so as to drill a hole larger than said casing tube.

Such drilling tools of varying design are for example described i EP patent publication 0 263 088 A2, U.S. Pat. No. 2,485,826, U.S. Pat. No. 3,370,658, U.S. Pat. No. 4,408,669, and CA 821404, and are used in foundation work and waterwell drilling. The drilling tool has to operate efficiently in rock as well as in ground of widely varying character and stone content. Particularly at drilling in heavy clay containing ground there often arise problems due to clogged flushing passages. Available flushing medium pressure is often insufficient for blowing clean the passages and to put the situation right creates undesirable and costly delays in the work.

It is an object of the invention to introduce means for providing a momentary increase of the flushing effect in order to improve the drilling work in heavy ground. Simultaneously therewith an improvement of the drilling tool operation of can be gained by a better cleaning of the cutting front on the laterally protruding bit portion of the tool. These objects are attained by the characterizing features of the appended claims.

Figure 1:
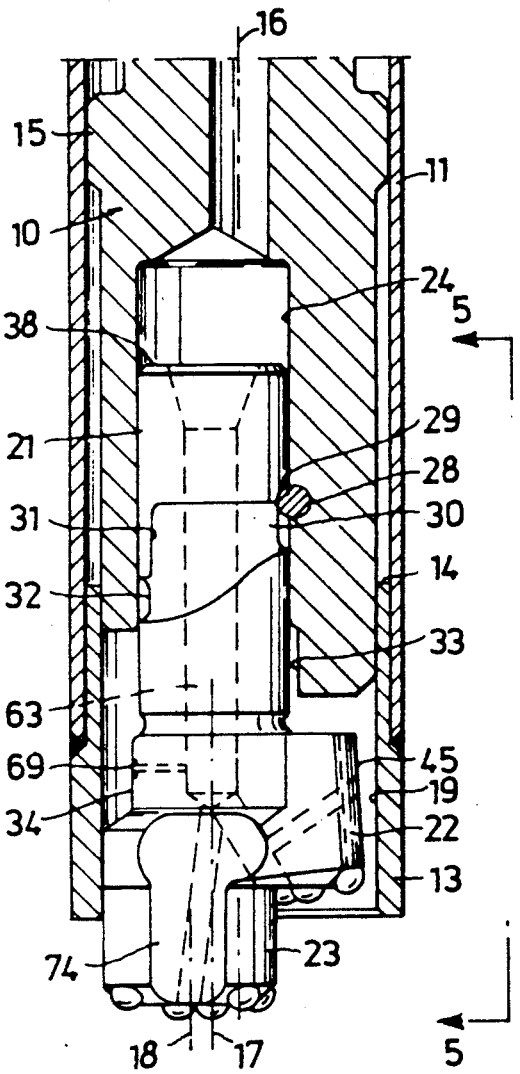
Figure 2:
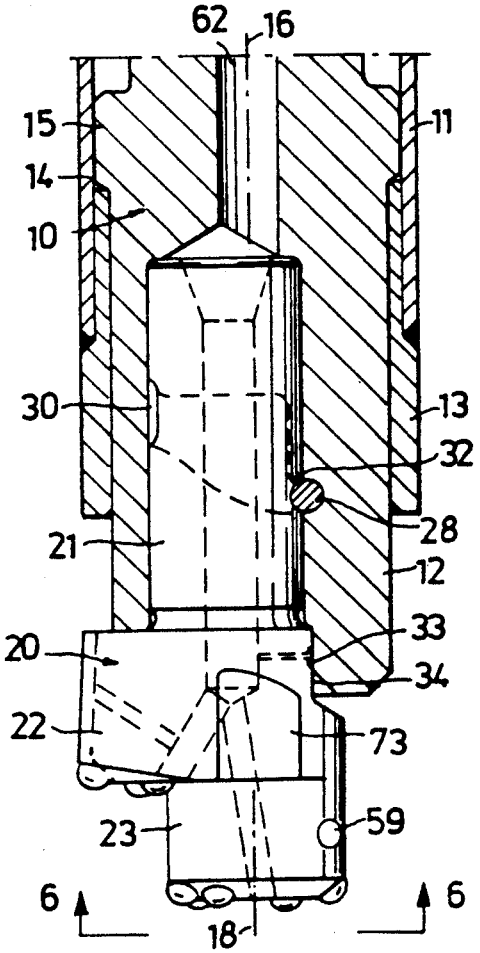
Figure 3:
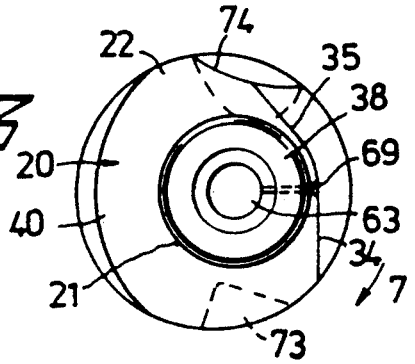
Figure 4:
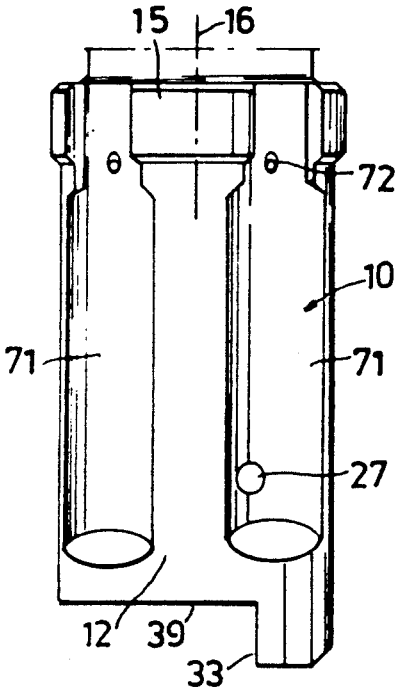
Figure 5:
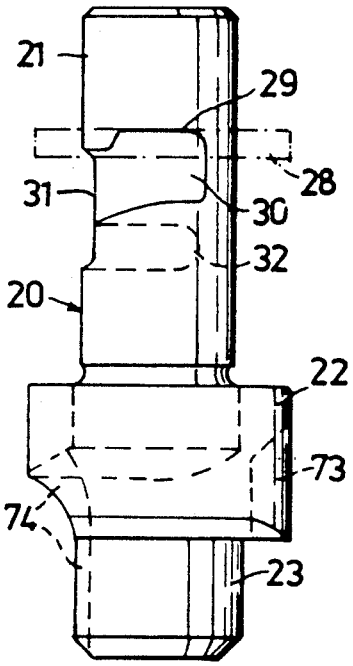
Figure 6:
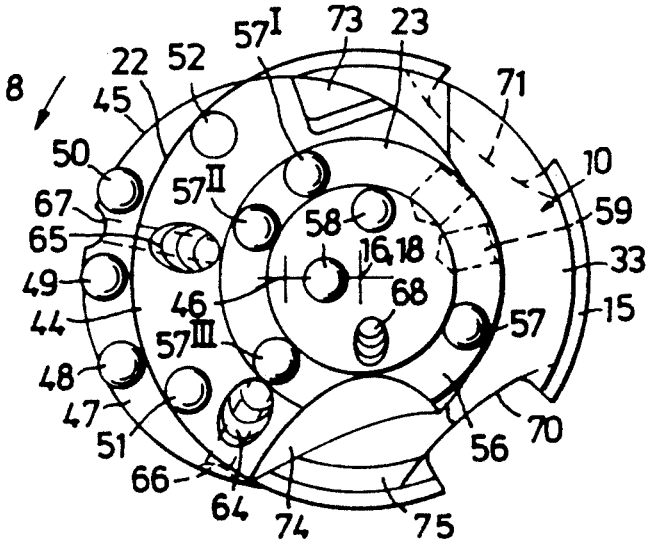

An embodiment of the invention adapted to one of the drilling tool variants applicable to the intended type of drilling work is described hereinafter with reference to the enclosed drawings, wherein FIG. 1 shows the drilling tool in cross section during passage of the guide member through the casing tube with a drill bit, shown in side view, hanging down therefrom in retracted position. FIG. 2 shows a corresponding view with the drill bit in drilling position adjacent to the guide member which is supported in the casing shoe at the mouth of the casing tube. FIG. 3 is a rear end view of the drill bit in FIG. 2. FIG. 4 is a side view of the guide member in FIG. 2. FIG. 5 is a side view of the drill bit in FIG. 1 seen in the direction of arrows 5—5. FIG. 6 is a somewhat enlarged end view of the drill bit and guide member in FIG. 2 seen in the direction of arrows 6—6.

The guide member 10 is in the usual way coupled to a drill string extending through the casing tube 11. In the example shown the drill string rotates the guide member 10 in the clockwise direction when viewed from above and delivers impact energy thereto from a tophammer above ground or from a downhole drill coupled in impact generating position between the drill string and the guide member 10. The drill string and the parts associated therewith are conventional and not shown in the drawings.

The guide member 10 has a circularly cylindrical guide portion 12 which with a centering fit is guided by the mouth of the casing tube 11 for rotation coaxially with the drilling axis 16. In the example shown illustrating drive by a down-the-hole drill, the mouth of the casing tube has welded thereon a guide shoe 13, which provides an internal shoulder 14 in the casing tube and a circularly cylindrical guide opening for the guide portion 12. The guide member 10 has axial abutments 15 at the rear thereon abutting on the shoulder 14 whereby part of the impact power from the downhole drill is transmitted to drive down the casing tube 11, FIG. 2.

The drill bit 20 incorporates a rear shaft 21 in one piece with an eccentric portion or bit 22 and a pilot bit 23. The shaft 21 is pivotally journalled in the guide member 10 in and around the axis 17 of an eccentric bore 24 extending in laterally spaced and parallel relation to the drilling axis 16. The pilot bit 23 in its turn is centered on an axis 18 which is parallel with the axes 16,17 but has the double lateral spacing to the drilling axis 16 when compared to the shaft axis 17.

When the drill bit 20 takes an angular position in the bore 24 with the pilot bit axis 18 at such maximal distance from the drilling axis 16, FIG. 1, both the pilot bit 23 at one side of the shaft axis 17 and the eccentric bit at the opposite side thereof are directed such that both bits fall within the outer contour of the cylindrical guide portion 12 and thus can pass freely through the guide opening 19 of the guide shoe 13 as shown in FIG. 1.

When the drill bit is turned about 180 degrees from the aforementioned position the axes 16,18 coincide. The pilot bit thus becomes coaxial with the drilling axis 16 and the eccentric bit is projected laterally sufficiently beyond the outer contour of the guide shoe 13 so as to be able to drill a hole larger than the casing tube 11. Such position is illustrated in FIG. 2.

In the radially retracted position of FIG. 1 the drill bit 20 hangs freely in the guide member 10, being retained axially form-bound thereto by follower means such as a cam follower 28. In the example shown the cam follower is a pin 28 inserted in a transverse bore 27 in the guide member 10 and projecting into the bore 24 for cooperation with an arresting groove 29 in the rear shaft 21. With the drill bit 20 hanging freely in retracted position, the pin 28 will engage the arresting groove 29 and is thereby kept bidirectionally arrested form-bound against rotation relative to the guide member 10 so as to be able to pass safely through the casing tube.

The arresting groove 29 opens from behind into a peripheral rear end groove 30 in the shaft 21. When the drill bit 20 meets the surface to be drilled, the cam follower 28 enters the end groove 30. The latter allows an angular form-restricted movement of about 90 degrees to be performed by the guide member 10 relative to the drill bit 20 clockwise in the drill rotating direction until the cam follower 28 reaches a forwardly directed cam groove 31. Therein the cam follower 28 is allowed to move axially in forward direction until met by a peripheral forward end groove 32. Continued rotation in the drill rotating direction of the guide member 10 some further 90 degrees locks the cam follower 28 form-bound in axial direction in and by the forward end groove 32 as shown in FIG. 2. The illustrated helical surface shown opposite to the straight one of cam groove 31 is generated when said groove is milled by a cylindrical tool and comes in helpful for guiding the complex movement of the drill bit 20.

The position in FIG. 2 is the drilling position of the drill bit 20. The shoulder 14 of guide shoe 13 or (when tophammer drilling is practiced, and the guide member 10 is centered by the interior of the casing tube 11 itself) the predetermined bound axial relationship between the drill string and the casing tube 11 has to define such an exposure of the guide portion 12 in front of the forward edge of the casing shoe 13 or casing tube 11 that the distance therebetween and between back 40 of the eccentric bit 22 approximately will be equal to or somewhat larger than the length of the pilot bit 23. A stuck casing tube will thus be unable to prevent lifting of the pilot bit 23 from its leading hole and the drill bit 20 is then free to be turned into the retracted position. During the peripheral and axial relative movement of the drill bit 20 from the position in FIG. 1 the cam grooves 30-32 and the pin 28 function as cooperating cam and follower means whereby the drill bit is guided and is in the drilling position of FIG. 2 brought adjacent to and in front of an axially protruding shoulder 33 on the guide member 20. During drilling the shoulder 33 abuts against a mating transverse abutment 34, shown in FIG. 3, and transmits drilling rotation (arrow 7) to the drill bit 20 simultaneously with pressing the cam follower 28 into and locking it in the forward end groove 32. In the drilling position of FIG. 2 the end 38 of shaft 21 is in engagement with the bottom of bore 24 and concurrently therewith the axial face 39 of the guide member also transmits impact power to the back 40 of the eccentric bit 22.

The form-bound guidance of the drill bit 20 allows, due to the axial movability of the follower 28 in cam groove 31, that powerful blows by cam follower 28 can be directed upward against the rear cam groove 30 in order to hammer free a stuck drill bit 20. The pivotal movement and a rounded surface at 35 on the abutment 34, FIG. 3, allows turning movement of the guide member 10 to bring follower 28 into axially movable position even with the drill bit stuck, notwithstanding that the shaft 21 then takes eccentric position. Incidentally, in this and in the locked drilling position the casing tube 11 can be knocked upward from a jammed position by means of back 40 (FIG. 3) of the drill bit 20. Repeated short raising of the drill bit 20 in its drilling position and subsequent blowing eases cleaning of the working surface and of the forward portion of the drill bit 20 from clay. Positioning of the drill bit 20 in axially retracted fixed angular position above a hindering stone edge allows crushing or knocking aside the stone by blows without drill rotation so that drilling then can be continued the normal way.

The drilling tool preferably drills by means of tungsten carbide buttons fitted on the front surfaces of the pilot and eccentric bits 23,22. FIG. 6 shows the preferred disposition of the tungsten carbide buttons on the drill bit 20. The eccentric bit 22 has a level front surface 44, a laterally protruding partly conical rearwardly-inwardly slanting mantle surface 45 having a central cone axis at 46, and a sickle shaped transition chamfer 47 that joins the front surface 44. The chamfer 47 carries at the maximal protrusion or central plane (through the axes 17,18) of the eccentric bit 22 two or, as in the example shown, three outwardly slanted symmetrically arranged hard metal buttons 48,49,50 which at drilling cut the maximum diameter of the tool. Leading in the rotational direction (arrow 8) is positioned an axial button 51 on the front surface 44 adjacent to and tangential to its periphery, i.e. the inner side of chamfer 47. A further axially directed button 52 can be inserted into surface 44 trailing in the rotational direction after the oblique peripheral buttons 48-50. The buttons 51,52 are spaced from the mantle of the pilot bit 23 in order to improve during drilling he crushing work around the rim of the pilot hole.

The pilot bit 23 is in the FIG. 6 position coaxial with the guide body 10 and has forwardly a circumferential chamfer 56 carrying thereon a number of outwardly slanting peripheral buttons 57,57$^{I}$-57$^{III}$ that define the diameter of the pilot hole drilled. The frontal surface of the pilot bit 23 carries a few, for example two, axially directed buttons 58.

During drilling a predominating part of the drilling work falls on the two leading buttons 51,48 of the eccentric bit 22. Study of the wear of the pilot portion shows that the load acting on these buttons tends to turn the back of the eccentric bit 22 in the rotational direction (arrow 8) with the buttons 51,48 as center. This results in a high radial pressure in a direction diametrically opposite to the buttons 51,48, a load that is taken up by the centering mantle surface of the pilot bit 22 in the quadrant or peripheral section of the pilot hole opposite to the buttons 51,48. In that section (between the buttons 57,57$^{I}$ in FIG. 6) therefore no diameter cutting buttons can be allowed since the radial load otherwise would rapidly cause a deviation of the pilot hole in a direction that in due course would reduce the maximum diameter cut by the eccentric bit 22, so that the casing tube finally would become stuck. Wear on the corresponding peripheral portion of the pilot bit 23 has an analogous effect and therefore the mantle surface of the pilot bit 23 at said its forward best centering portion is provided with one or a few gauging buttons 59, preferably two coplanar blunt buttons of hard metal as shown in the example. The pilot bit 23 must have a length assuring that a sufficient guiding surface is provided around the bottom of the pilot hole spaced in front of its substantially funnel shaped mouth that is crushed up and widened by the buttons 51,52.

Flushing medium, for example exhaust air from the downhole drill, is supplied to a passage 62 in the guide body 10 and led on to a passage 63 in the drill bit 20 and from there to branch passages terminated by openings 64,65 on the front surface 44 of the eccentric bit 22, to ejector branch passages directed rearwards each into an axial groove 66,67 on the mantle 45 of the eccentric bit 22, to a branch passage terminated by an opening 68 in the front of the pilot bit 23, as well as into a further branch passage terminated by opening 69, FIGS. 1,3, for flushing clean the area in front of shoulder 33.

The guide member 10 has preferably three hollowed out, shallow straight flushing grooves 71 in its guide portion 12. The grooves 71 are somewhat narrowed at their rear and are open between the lugs 15. Rearwardly directed ejector openings 72 open up between these lugs 15 and are connected to the interior flushing passage 62 of guide member 10 so as to improve flushing of the grooves 71. At their forward ends grooves 71 are ending blindly into the periphery of the guide portion 12 before reaching the forward edge 39 of the guide member 10, FIG. 4. A fourth similar flushing groove 70 extends axially from front to rear along the entire guide member 10 and is shown from below in FIG. 6. The flushing groove 70 is connected so as to vent the flank of the eccentric bit 22 in FIG. 6 that precedes in the rotational direction (arrow 8) the maximally loaded buttons 51,48-50 during drilling, whereas the flushing openings 64,65 open out within the working area of these buttons. As a result there is provided an effective cleaning by a flushing medium stream directed predominantly in counter direction to the rotation (arrow 8), firstly along the front surfaces 44,47 of the eccentric bit 22, then, guided by an axially directed notch 73 in its mantle past the front face of shoulder 33, in behind the back of bit 22, and finally out through the flushing groove 70. Part of the stream is simultaneously directed forward in the rotational direction via a guide groove 74, directly towards flushing groove 70 in order to counteract recirculation of debris around pilot bit 23. The guide groove 74, FIGS. 1,2,6 is scoop-shaped in the rotationally leading flank of the eccentric bit 22 in order to provide a shovelling favourable in clay-bound earth. As shown, the guide groove may be extended axially through the pilot bit 23 for improved guiding of the flushing stream.

The three blindly ending flushing grooves 71 extend in drilling position of guide member 10 out in front of the forward edge of the casing shoe 13 and effect removal of the mixture of flushing medium and drill cuttings expelled axially from inter alia the axial grooves 66,67 and otherwise to the enlarged drill hole around the protruding front end of guide portion 12, thereby easing the driving down of the casing tube 11. At a tendency of the flushing groove to become choked for example by clay, the guide member 10 can be retracted to bring the back 40 of the eccentric portion 22 into abutting relation against the casing shoe 13. In case of downhole drilling the supply of flushing medium will simultaneously herewith be increased due to the so called hanging reaction of the downhole drill. At such retraction the blind flushing grooves 71 become closed by the interior surface of the casing shoe 13 and that renders a reinforced blowgun-like clean-blowing of the sole flushing groove 70 and of the drill parts in front thereof.

In case of need the available venting cross section can be increased by providing further permanently open flushing grooves 70 or simply by the provision of a transverse notch 75, FIG. 6, in the front of the guide portion 12, whereby the flushing groove 70 is joined to an adjacent blind groove 71, preferably the one trailing in the rotational direction (concealed in FIG. 6) as compared to flushing groove 70.

The invention is not restricted to the described drilling tool but can be modified and applied inter alia in the drilling tool variants referred-to at the outset of this description or in other applications, all within the scope of the appended claims.

I claim:

1. Flushing means for drilling tools intended for drilling in earth and in rock covered by overburden concurrently with a casing tube (11) following the drilling tool downhole, said means incorporating passages (62, 63) for supplying flushing medium to the hole during drilling, a guide member (10) rotatably centered by said casing tube (11) and having at least two outer flushing grooves (70, 71) thereon for the outflow of flushing medium and drilling debris from said hole into said casing tube (11) during drilling, and a drill bit (20) supported by said guide member (10) and provided with a bit portion (22) thereon spaced from and projecting laterally beyond said casing tube (11) so as to drill a hole larger than said casing tube (11), said flushing means being characterized by at least one of said flushing grooves (70) extending the full length of said guide member (10) from front to rear thereof, at least one further flushing groove (71) on said guide member (10) being open-ended towards said rear but ending blindly into the periphery of said guide member (10) in spaced relation to said front and axially beyond said casing tube (11) so as to allow said outflow to pass freely into said casing tube (11) through all said grooves (70, 71) during drilling and then to close said at least one blind groove (71) by retracting said guide member (10) into said casing tube (11) sufficiently to leave only said at least one full length groove (70) open to said outflow.

2. Flushing means according to claim 1 wherein an axial guide groove (74) is provided on said drill bit (20) for directing said outflow towards said full length groove (70) at drilling.

3. Flushing means according to claim 1 wherein said drill but (20) is provided with a laterally extending eccentric bit (22) thereon movably supported by said guide member (10) between a drilling position, wherein the eccentric bit (22) projects laterally beyond said casing tube (11) so as to drill a hole larger than said casing tube (11), and a retracted position in which the drill bit can be retracted or lowered through the casing tube (11), and wherein the flushing medium is firstly supplied to the front (44) of said eccentric bit (22) through openings (64,65) disposed in the quadrant (between 66,67) of said bit front (44) trailing relative to said full length groove (70) in relation to the rotational direction (8) during drilling, and then is led peripherally counter to said direction on towards said full length groove (70).

4. Flushing means according to claim 1 wherein said guide member (10) has at least four peripherally spaced axial flushing grooves (70, 71) thereon, and a notch (75) is provided at the front of said guide member (10) for permanently connecting said full length groove (70) to an adjacent blind groove (71) so as to increase the outflow capacity of said full length groove (70) at retraction of said guide member (10).

5. Flushing means according to claim 3 wherein an axially directed notch (73) is provided on said eccentric bit (22) angularly spaced from said quadrant so as to lead flushing medium on axially past said eccentric bit (22) towards said full length groove (70).

6. Flushing means according to claim 2 wherein said drill bit (20) is provided with a forward pilot bit (23) and therebehind a laterally extending eccentric bit (22) movably supported relative to said guide member (10) between a drilling position, in which the eccentric bit (22) projects laterally beyond said casing tube (11) so as to drill a hole larger than said casing tube (11), and a retracted position, in which the drill bit can be retracted or lowered through the casing tube (11), and wherein said guide groove (74) is scoop-shaped and provided on the flank of said eccentric bit (22) facing in the rotational drilling direction (8).

7. Flushing means according to claim 1 wherein said laterally projecting bit portion (22) during drilling is spaced axially from said casing tube (11) sufficiently to allow said guide member (10) to be retracted axially so as to close said blind grooves (71) by the mouth of said casing tube (11).

8. Flushing means for drilling tools intended for drilling in earth and in rock covered by overburden concurrently with a casing tube (11) following the drilling tool downhole, said means comprising a guide member (10) rotatably centered by said casing tube (11) and having at least one outer flushing groove (70, 71) thereon for the outflow of flushing medium and drilling debris from said hole into said casing tube (11) during drilling, a drill bit (20) provided with a forward pilot bit (23) thereon and therebehind with a laterally extending eccentric bit (22) movably supported relative to said guide member (10) between a drilling position, in which the eccentric bit (22) projects laterally beyond said casing tube (11), and a retracted position, in which the drill bit can be retracted or lowered through the casing tube (11), and an axial scoop shaped guide groove (74) provided on the flank of the eccentric bit (22) facing in the rotational drilling direction, said guide groove (74) extending in rearwardly radially and outwardly slanted relation from the front surface (44) of the eccentric-bit (22) for shovelling said outflow directly towards one (70) of said flushing grooves (70,71) at drilling.

9. Flushing means according to claim 6, wherein said guide groove (74) extends through said pilot bit (23) and is terminated in scoop-shape on said eccentric bit.

10. Flushing means according to claim 2, wherein said drill bit (20) is provided with a laterally extending eccentric bit (22) thereon movably supported by said guide member (10) between a drilling position, wherein the eccentric bit (22) projects laterally beyond said casing tube (11) so as to drill a hole larger than said casing tube (11), and a retracted position in which the drill bit can be retracted or lowered through the casing tube (11), and wherein the flushing medium is firstly supplied to the front (44) of said eccentric bit (22) through openings (64,65) disposed in the quadrant (between 66,67) of said bit front (44) trailing relative to said full length groove (70) in relation to the rotational direction (8) during drilling, and then is led peripherally counter to said direction on towards said full length groove (70).

11. Flushing means according to claim 2, wherein said guide member (10) has at least four peripherally spaced axial flushing grooves (70, 71) thereon, and a notch (75) is provided at the front of said guide member (10) for permanently connecting said full length groove (70) to an adjacent blind groove (71) so as to increase the outflow capacity of said full length groove (70) at retraction of said guide member (10).

12. Flushing means according to claim 3, wherein said guide member (10) has at least four peripherally spaced axial flushing grooves (70, 71) thereon, and a notch (75) is provided at the front of said guide member (10) for permanently connecting said full length groove (70) to an adjacent blind groove (71) so as to increase the outflow capacity of said full length groove (70) at retraction of said guide member (10).

13. Flushing means according to claim 3, wherein said laterally projecting bit portion (22) during drilling is spaced axially from said casing tube (11) sufficiently to allow said guide member (10) to be retracted axially so as to close said blind grooves (71) by the mouth of said casing tube (11).

14. Flushing means according to claim 8 wherein said guide groove (74) extends axially along said pilot bit (23) and is terminated in a scoop-shape on said eccentric bit.

* * * * *